United States Patent [19]

Knoop et al.

[11] 4,348,252

[45] Sep. 7, 1982

[54] DEVICE FOR THE INSERTION AND EXTRACTION OF A LAMINATING PACK IN AND FROM A PRESS

[75] Inventors: Heinrich Knoop, Allgau; Heinrich Pfeiffer, Eppingen, both of Fed. Rep. of Germany

[73] Assignee: Maschinenfabrik J. Dieffenbacher GmbH & Co., Eppingen, Fed. Rep. of Germany

[21] Appl. No.: 253,017

[22] Filed: Apr. 10, 1981

[30] Foreign Application Priority Data

Jan. 12, 1980 [DE] Fed. Rep. of Germany ..... 3000967

[51] Int. Cl.[3] ..... B30B 15/30; B30B 15/32

[52] U.S. Cl. ..... 156/538; 100/93 P; 100/215; 100/218; 100/229 R; 156/580; 156/583.1

[58] Field of Search ..... 156/538, 539, 580, 583.1; 100/93 P, 215, 142, 196, 218, 229 R

[56] References Cited

U.S. PATENT DOCUMENTS

| | | | |
|---|---|---|---|
| 3,655,316 | 4/1972 | Hüsges | 100/218 |
| 3,810,730 | 5/1974 | Carlsson | 100/196 |
| 3,909,343 | 9/1975 | Posselt | 156/583.1 |
| 3,977,535 | 8/1976 | Hüsges et al. | 156/538 |
| 4,253,891 | 3/1981 | Brussel | 156/583.1 |

*Primary Examiner*—Michael G. Wityshyn

*Attorney, Agent, or Firm*—Schwartz, Jeffery, Schwaab, Mack, Blumenthal & Koch

[57] ABSTRACT

A single unit moves into and out of a press to essentially simultaneously charge the press with the workpiece to be processed and discharge another workpiece which has been processed. The device is particularly suitable for preparing laminates in which the workpiece to be processed comprises a stack of alternating sheets of solid material and bonding material. This workpiece is referred to as a laminating pack. A table on a transfer car holds the unprocessed laminating pack. This same transfer car also has on its lower side a plurality of suction devices for grippingly engaging a processed laminate, i.e., a laminate that has been treated in the heat press. The transfer car holding the unprocessed laminating pack advances into an open press. In the press, the laminating pack is transported onto holding gibs, and the processed laminate in the press is taken up by the suction means on the bottom side of the transfer car. The transfer car is then retracted from the press with the processed laminate, and the laminating pack is left behind in the press for processing. This simultaneous charging and discharging operation is then repeated.

17 Claims, 17 Drawing Figures

DEVICE FOR THE INSERTION AND EXTRACTION OF A LAMINATING PACK IN AND FROM A PRESS

BACKGROUND OF THE INVENTION

1. Technical Field of the Disclosure

The invention relates to a charging and discharging device for the insertion and extraction of a laminating pack in and from a press.

2. Description of the Prior Art

As the press times for the laminating of sheets, particularly with melamine films, amount only to 20 to 30 seconds and the press times for the laminating of paper with urea resin adhesives to 3 to 8 seconds, the handling time required for the charging and discharging of a press represents a significant time and cost factor.

According to the state of the art as seen from German Offenlegungsschrift No. 28 25 206, the laminating pack (which consists of sheets of a wooden material and/or impregnated papers, laminated sheets, veneer or similar hardening layers together with melamine films placed on either side of the sheets of layers) is pressed at 120° C. to 210° C. and pressures of 8 kg/cm$^2$ to 40 kg/cm$^2$. The individual layers and the carrier sheet are assembled outside the heat press by means of a collating device and placed on a supporting device, in particular on a roller table, for advancing into the press.

The roller table with the laminating pack subsequently moves from the charging side into the opened heat press. Simultaneously, a movable car which is staggered in height with respect to the roller table travels into the heat press from the discharge side and grips the finished sheet by suction.

Both transfer devices, namely the suction car and the roller table, retract simultaneously from the press area. In the process, the roller table initiates the discharge of the sheet onto a discharge roller band arranged on the top of the suction car. The retracting of the transfer devices and the roller bands is controlled so that the laminating pack is held—supported on its frontal sides—at a distance and in a predetermined position over the press table and so that the laminating pack is placed on the press table at a time which is only immediately prior to pressing and which is approximately simultaneous with the departure of the two transfer devices from the press area. It is difficult during this charging process to coordinate all of the four motion cycles with each other and to regulate them so that the sensitive coating layers of the workpiece will not be damaged.

SUMMARY OF THE INVENTION

It is the object of the invention to provide a charging and discharging device capable of effecting a more rapid and simpler insertion and extraction of the laminating pack into and from the press area so that, with its use, the overall cycle time may be shortened.

The device according to the invention has the advantage, in relation to the state of the art, that the working cycle (and thus the manufacturing time and production costs) of a laminate are reduced by the simultaneous insertion and extraction from one side of both a new laminating pack and also the finished sheet.

Another advantage resides in the capability of effecting a rapid and efficient transfer of the unprocessed laminate pack from the transport device to the press by a device on the opposite, free side of the press.

Yet another advantage resides in the capability of rapidly and efficiently adjusting the apparatus for handling the laminating packs by a device on the opposite, free side of the press, for facilitating handling of different-sized laminating packs.

A further advantage is that only a single device is run in and out of the press. Thus, charging and discharging may be effected more simply and more rapidly.

To reiterate and to expand on the foregoing, the device of the present invention is for inserting a workpiece in the form of a laminating pack to be processed into a press in a charging direction and for extracting the workpiece which has become a processed laminate from the press in a discharging direction. The press has a plurality of sides. The device of the invention includes a means for charging the press by depositing a laminating pack therein, the charging means including a table for receiving, holding and discharging the laminating pack. The device also includes means for discharging the press by taking up a processed laminate from the press, the discharging means including a suction means for gripping the processed laminate by suction. The charging and discharging means are operatively coupled together for cooperation with each other. There are a plurality of holding gibs which cooperate with the charging means and which extend into the press for holding laminating packs deposited in the press by the charging means. There is also means for inserting a laminating pack into one side of the press and for extracting a processed laminate from the same side of the press. Further, there is means for effecting simultaneous deposit of the laminating pack onto the holding gibs and take up of the processed laminate by the suction means. This inserting and extracting means and this means for effecting simultaneous deposit and take up together comprise a transfer car which is movable into and out of the press, the transfer car having an upper part and a lower part, the table of the charging means being disposed on the upper part, the suction device of the discharge means being located on the lower part. Thus, the charging and discharging devices are located one above the other in the transfer car, and the charging device, discharging device and transfer car are all part of a single unit which is movable into and out of the press.

The laminating pack has a front side which is disposed opposite the one side of the press, i.e., the charging side, when the laminating pack has been inserted into the press. There are means for additionally supporting the laminating pack on the front side thereof when the laminating pack has been inserted into the press. This additional supporting means includes a roller band which is movable into and out of the press. The additional supporting means cpooperates with the charging means to effect depositing of the laminating pack in the press.

The press is elongated and includes a longitudinal axis and two longitudinal sides which extend in parallel relationship to the longitudinal axis. The longitudinal sides also extend in perpendicular relationship to the one side, i.e., the charging side, of the press. There are means for effecting sliding movement of the holding gibs into and out of the press past the two longitudinal sides of the press and in a direction transverse to the longitudinal axis of the press. The sliding movement means is coupled with the holding gibs. Also, the sliding movement means is mounted for raising and lowering movement with respect to the press. The holding gibs may comprise hinged tongs capable of closing and opening.

The laminating pack has a width which extends transversely to the charging direction. The transfer car and the roller table thereon each have a longitudinal axis which extends in the same direction as the longitudinal axis of the press.

The transfer car and the roller table thereon each have a width which extends perpendicularly to the longitudinal axis thereof. The transfer car and roller table thereon are each slightly narrower in width than the width of the laminating pack. The transfer car and roller table thereon include means for effecting variation of the width thereof.

The roller table may include a pair of displaceable roller bands thereon for effecting horizontal movement of laminating packs with respect to the transfer car. The roller bands are disposed in parallel relationship to one another.

The transfer car includes lateral sides running parallel to its longitudinal axis. There are a pair of supporting cleats disposed externally of the press at one side thereof, the supporting cleats cooperating with the holding gibs to serve as an extension of the holding gibs. The supporting cleats are fixed relative to the press so that the transfer car moves relative to the supporting cleats. The supporting cleats are disposed on opposite sides of the transfer car and are slightly laterally offset from the lateral sides thereof to thus serve as supports for the laminating packs when the transfer car is outside of the press.

Each laminating pack has a plurality of sheets therein, and the transfer car has a frontal side which faces toward the one side of the press when the transfer car is outside the press. There are means for clampingly engaging the laminating pack when the laminating pack is on the charging means of the transfer car to hold the sheets of the laminating pack together when the transfer car moves in the charging direction. The clamping means is coupled with the transfer car adjacent the frontal side of the transfer car.

The transfer car has an exterior and has a frontal side which faces toward the one side of the press when the transfer car is outside of the press. There is a projecting member on the transfer car for rollably supporting the workpiece in a region beyond the exterior of the transfer car. This projecting member projects from the frontal side of the transfer car. The projecting member is mounted for generally upward and downward movement relative to the transfer car.

The press has a frontal side opposite its one charging side. The holding gibs include a pair of spaced apart holding gib portions. Each holding gib portion has a frontal side adjacent the frontal side of the press. The holding gib portions have means at their frontal sides for adjustably displacing the holding gib portions to effect accurate positioning of the laminating packs in the press.

As an alternative, the holding gibs may include a plurality of separate holding gib elements on one lateral side of the press and a plurality of separate holding gib elements on the other lateral side of the press.

The transfer car may include means for effecting lowering and raising thereof with respect to the press to, in turn, effect take up and discharge of the workpiece by the transfer car.

The overall device includes a plurality of guide rails with which the transfer car cooperates to effect guided movement of the transfer car. The guide rails may have portions disposed at different levels to effect raising and lowering movements of the transfer car with respect to the press to, in turn, effect take up and discharge of the workpiece by the transfer car.

The press includes upper and lower tups, and the lower tup may be raisable toward the upper tup. Guide rails, which are fixed with respect to the press and with which the transfer car cooperates, may extend to and from the press in the charging and discharging directions so that the transfer car may run into and out of the press on these guide rails. In a particular embodiment in which the guide rails are not necessarily disposed at different levels, the suction device is so disposed on the transfer car so as to grippingly contact the processed laminate when the lower tup of the press is raised toward the upper tup of the press.

Additionally, the table of the charging means may be mounted on the transfer car for raising and lowering movement with respect to the transfer car.

BRIEF DESCRIPTION OF THE DRAWING

The invention will become more apparent from the following description and accompanying drawing, wherein.

DETAILED DESCRIPTION OF THE PREFERRED EMBODIMENTS

Figure 1:
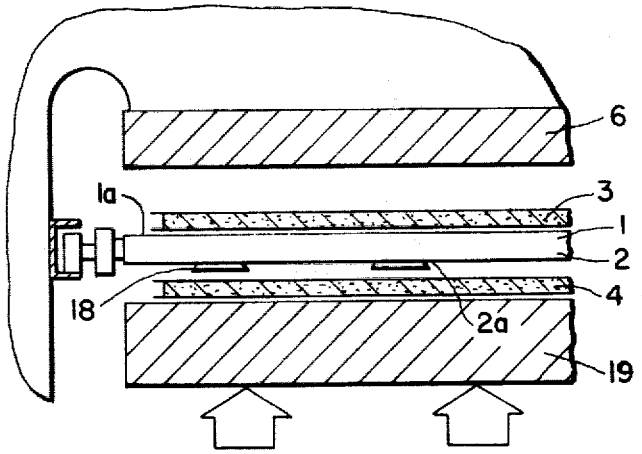
FIG. 1 shows in a schematic representation in a partial front sectional view a transfer car which has been advanced into the press and which carries a new laminating pack according to the invention.
Figure 2:
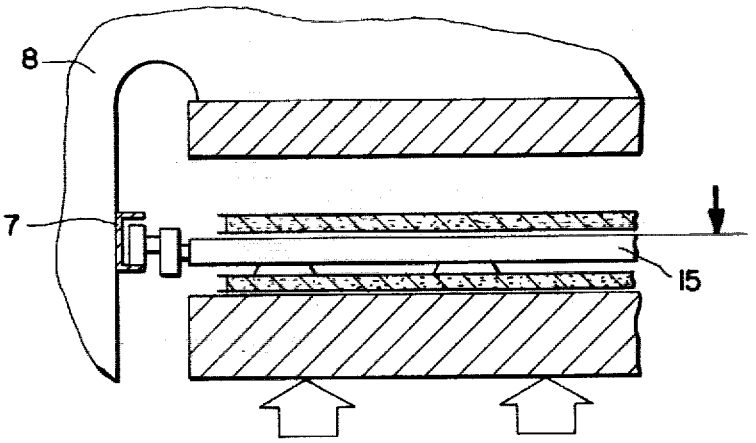
FIG. 2 is a view similar to FIG. 1 showing the transfer car lowered onto the finished laminate.
Figure 3:
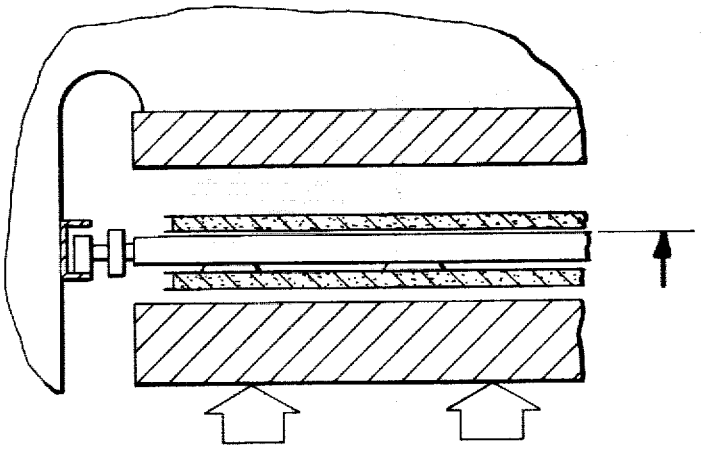
FIG. 3 is a view similar to FIG. 1 showing the transfer car with the laminate gripped by suction.
Figure 4:
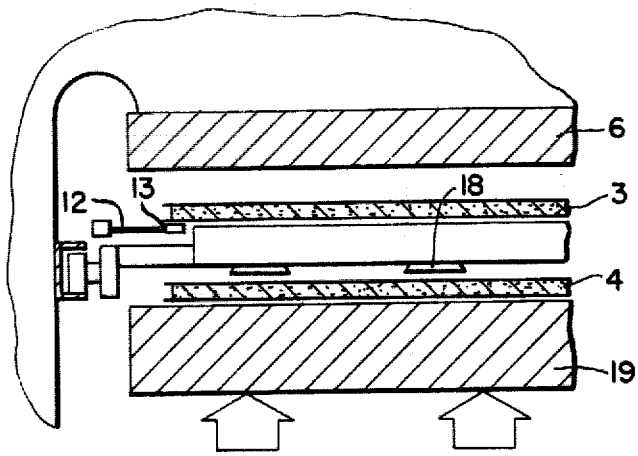
FIG. 4 shows a special embodiment of the transfer car for the placing of the laminating pack onto holding gibs in the press.

The device of the invention, in accordance with FIGS. 1–17, serves to effect the insertion, pressing and extraction of unpressed laminate press packs, designated hereinafter as laminating packs 3. The insertion of the new laminating pack 3 between the heat plates 6 and 19 of the heat press 8 and the extraction of the finished or processed laminate 4 is effected by means of a transfer car 15, movable in and out from one side of the press in the longitudinal direction. Reference numerals 6 and 19 can also be regarded as designating the upper and lower tups of the press 8.

Figure 15:
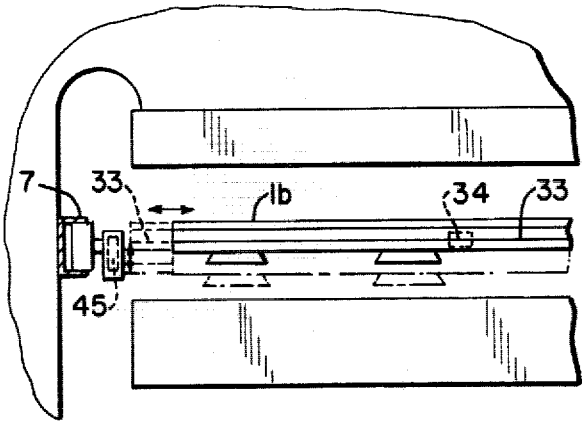
FIG. 15 is a partial fragmentary view similar to the view of FIGS. 1–6 showing various features of the transfer car and the upper table thereon.
Figure 17:
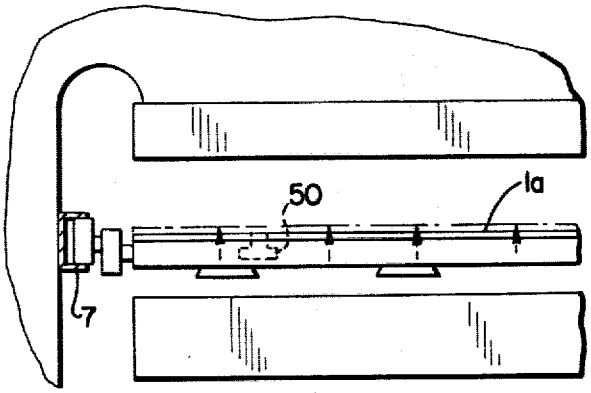
FIG. 17 shows in partial fragmentary sectional view similar to that of FIGS. 1–6 another feature of the transfer car and table therefor.

According to the invention, the charging and discharging device are on a transfer car 15 constructed in its lower part 2 as a raisable and lowerable suction device 2*a* and in its upper part 1 as a roller band table 1*a* of conventional design, thereby forming a single structural unit. During the charging and discharging of the press 8, the transfer car 15 runs into the press with the laminating pack 3, the suction device 2 descends, grips the finished laminate 4, and simultaneously the roller band 11 deposits the laminating pack 3 in the press 8. The transfer car 15 then runs out, and the press 8 is closed for the next pressing step. The finished laminate 4 is retracted with the transfer car 15 while being suspended from the suction device 2. This finished laminate is then placed onto a roller conveyor 16 and transported away. In order to obtain approximately the same retention time for all parts of the laminating pack 3 within the press, a support in the form of a supporting roller band 14 may be rotatably mounted adjacent the side opposite the charging side 38 of the press. Roller band 14 retracts from the press only shortly prior to the retraction of a rising and descending discharge projection 17 on the transfer car 15. This assures the approximately simultaneous, completely flat deposit of the laminating pack 3 in the press. To make possible the approximately simultaneous, accurate placement on the lower heat plate 19 of several laminating packs 3 arranged successively in the longitudinal direction on the roller band 11, the transfer car 15 with the roller band 11 either is constructed slightly narrower than the laminating pack 3 (FIGS. 4, 5 and 12) or is variable in width (FIG. 15). For this purpose, holding gibs 13, that may be moved in and out, are provided in the press area.

Figure 10:
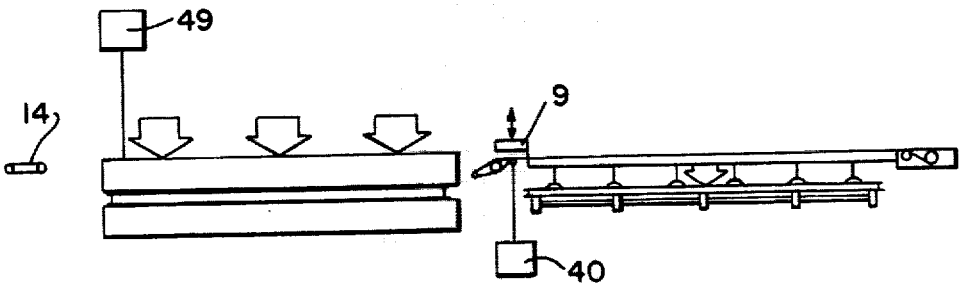
Figure 11:
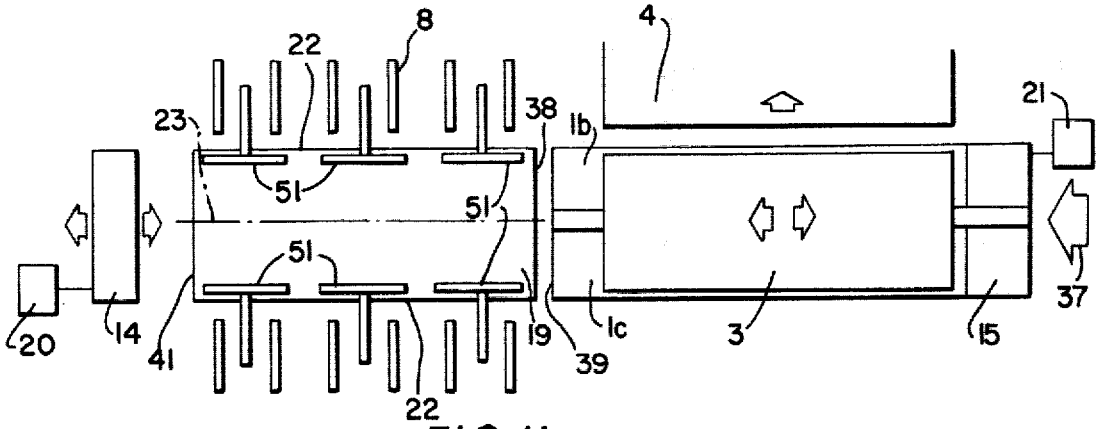
FIG. 11 shows schematically in a top view the motions of the laminating pack and the laminate into the press and from the press, respectively.
Figure 12:
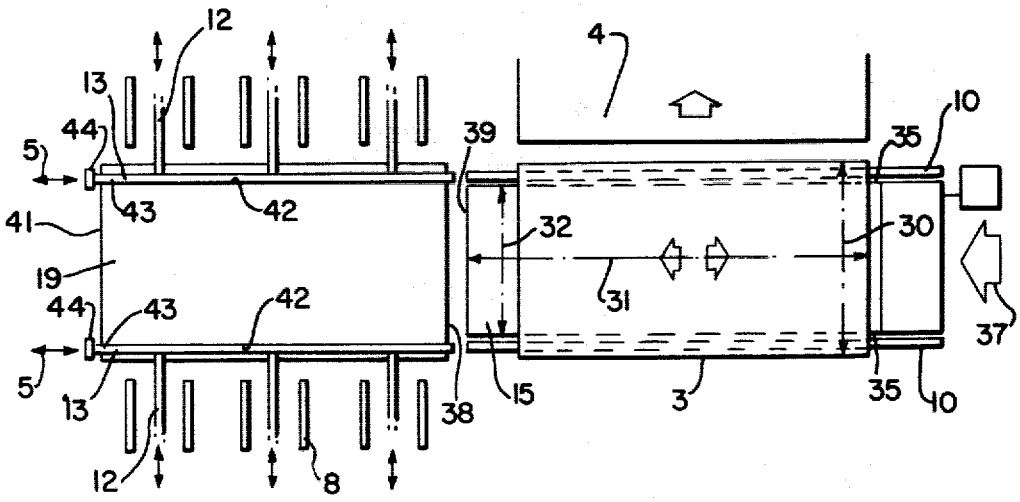
FIG. 12 shows schematically in a top view the arrangement of the holding gibs and supporting cleats in the press and outside the press, respectively.
Figure 13:
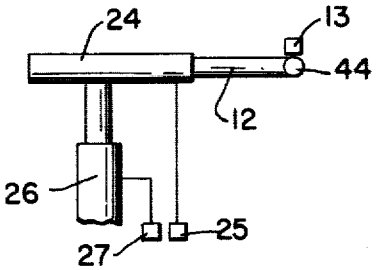
FIG. 13 is a detailed view in front elevation showing schematically part of the holding gibs and showing schematically what powers the holding gibs and their movements.

As indicated, the roller band 14 is movable into and out of the press. Such inward and outward movement may be accomplished by any suitable drive means schematically shown at 20 in FIG. 11. Similarly, it has been indicated that the transfer car 15 moves into and out of the press via side 38 of the press. Again, this is accomplished through the use of any suitable drive means as shown schematically at 21. The press 8 includes longitudinal sides 22 which are parallel to a longitudinal axis 23 of the press. The laminating pack 3 includes a width dimension 30 (FIG. 12). The transfer car 15 and table thereof has a longitudinal axis 31 as also shown in FIG. 12. They also have a width dimension 32 as shown. It has been mentioned that the transfer car and associated table may be variable in width. In this regard, FIG. 15 schematically shows a means for accomplishing this, including a slideable connection 33 between the upper and lower part of the transfer car to effect slideable movement of that portion of the transfer car and a holding device 34 for holding that part in its laterally adjusted position. Of course, the transfer car has lateral sides 35 (FIG. 12) which extend in the same direction as the charging direction (shown by arrow 37 in FIGS. 11 and 12). Of course, too, the transfer car includes a frontal side 39 (FIG. 11) and the press also includes a frontal side 41. It has been mentioned that the discharge projection 17 may rise and descend; and for this purpose and for driving the same, the discharge projection 17 is coupled with any suitable driving means 40 as schematically shown in FIG. 10.

Figure 5:
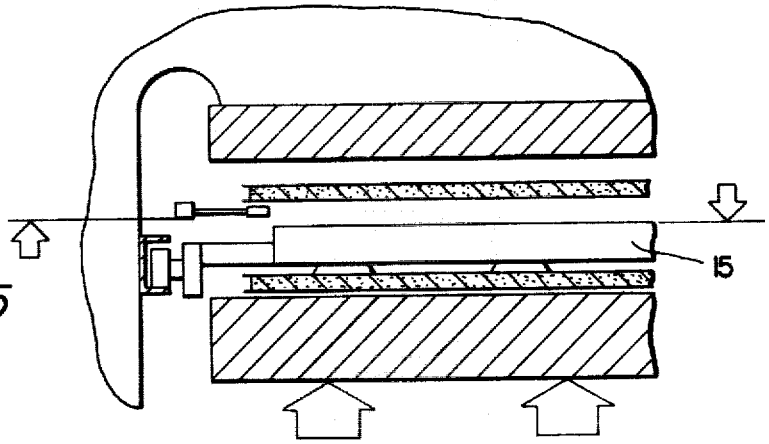
FIG. 5 shows the transfer car of the embodiment of FIG. 4 lowered onto the finished laminate and the holding gibs raised with the new laminating pack.
Figure 6:
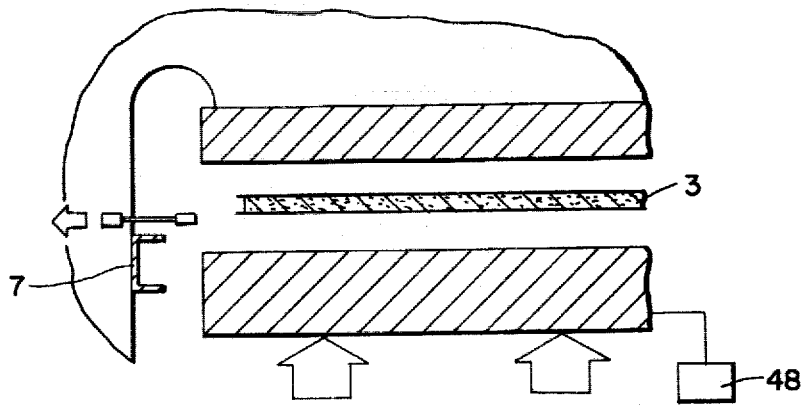
FIG. 6 shows in connection with the embodiment of FIG. 4 the new laminating pack shortly before its placing onto the pressing surface.
Figure 7:
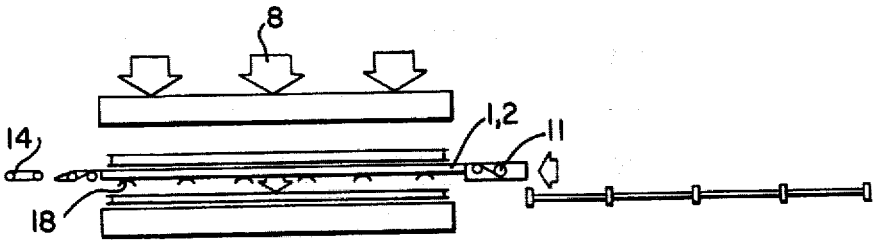
FIGS. 7 to 10 schematically illustrate in four separate side elevational views the charging and discharging process using the transfer car according to the invention.
Figure 8:
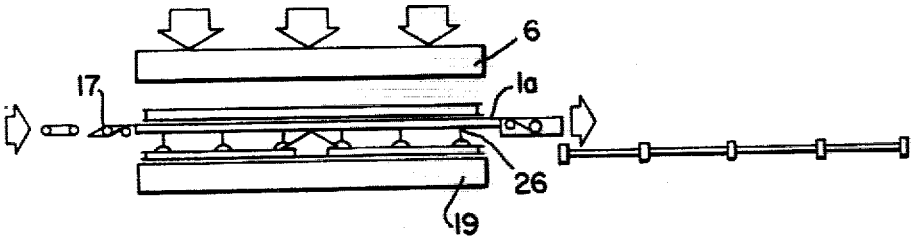
Figure 9:
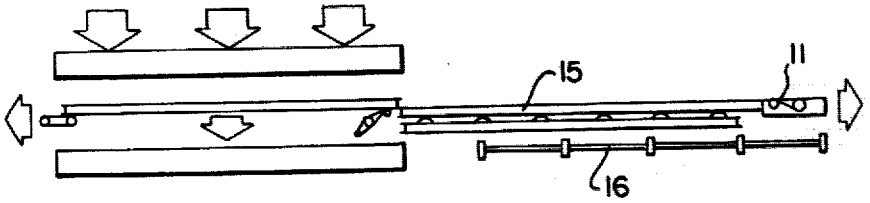
Figure 14:
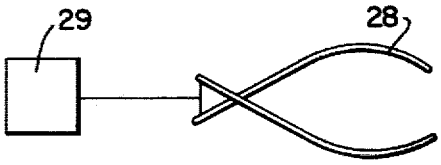
FIG. 14 is a detailed elevational view showing schematically holding gibs in the form of tongs and showing schematically a drive therefor.

Upon the opening of the press 8 and prior to the advancement of the transfer car 15, the two holding gibs 13 are moved into the press area by means of the inserting and withdrawing devices 12, and they take up a position under longitudinal edges of the laminating packs 3 which are to be treated. The laminating packs will extend over the holding gibs 13. With the lowering of the suction device 2 to take up the finished laminate 4 by means of the suction cups 18, the laminating pack or packs 3 are lifted by the raisable and lowerable inserting and withdrawing devices 12 (FIG. 5). During the closing cycle of the press 8, the holding gibs 13 are retracted successively from the press area; and the laminating packs drop onto the lower heat plate 19. The holding gibs 13 may take the form of opening and closing tongs 28 (FIG. 14) clamping the longitudinal axes of the laminating pack 3. Of course, any suitable drive means 29 as schematically shown in FIG. 14 may be used for the tongs. In order to assure the support of the lower film and of the laminate carrier, respectively, on both of the longitudinal edges, even outside the press, stationary supporting cleats 10 (FIG. 12) are installed to the right and the left of the transfer car 15 at a distance of 1 to 3 mm under the plane of the roller band.

Since the film is ionized prior to its placement on the roller band 11 and adheres well, the two supporting cleats 10 in front of the press 8 (FIG. 12) are intended as a safety measure. Should the film occasionally tend to sag, it will be carried without difficulty by the supporting cleat 10 safely into the press 8 and onto the holding gibs 13 which are located at the same height as the laminating pack in front of the press 8. For the final correct positioning of the laminating packs 3 on the heat plate 19, the holding gibs, if necessary, may be conveniently equipped at their frontal sides 43 with an adjusting device 44 (schematically shown in FIGS. 12 and 13) for adjusting the gibs in the direction of the arrow 5. To grip and hold several laminating packs 3, it may further be advantageous to construct the holding gibs 13 of a plurality of small holding gibs 51 as depicted in FIG. 11. However, in the preferred embodiment of the invention, the holding gibs take the form of spaced part, separate gib portions 42 as shown in FIG. 12. As indicated, the gibs are mounted for a lateral sliding movement with respect to the press. This may be accomplished by any suitable means such as shown schematically at 24 in FIG. 13, and the drive for such movement may be accomplished by any suitable drive means as shown schematically at 25. Similarly, it has been indicated that the holding gibs may be raised and lowered. Again, this may be effected by any suitable means which is shown schematically at 26 in FIG. 13, and the drive again may be any suitable drive as shown schematically at 27 in FIG. 13.

Figure 16:
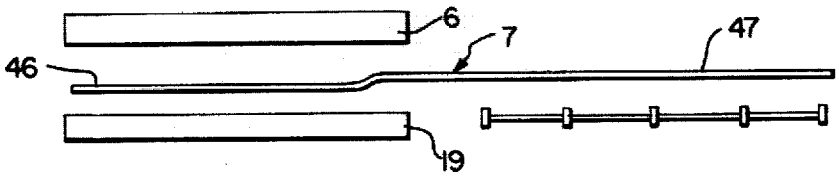
FIG. 16 schematically illustrates in side elevational view similar to those of FIGS. 7–10 a rail device for the transfer cars.

For the purpose of being able to handle laminating packs 3 of different widths with one transfer car 15, two displaceable roller bands 1*b*, 1*c* (FIGS. 11 and 15) arranged parallel to each other in the longitudinal direction are provided. A clamping device 9 (FIG. 10) is mounted on the frontal side 36 of the transfer car 15 to facilitate the rapid advancement of the laminating packs into the press 8. This prevents the lifting or shifting of the laminating pack 3 on the roller band 11 by the resistance of air. To replace the raising and lowering motion of the suction device 2, the transfer car 15 may be made to rise and descend by means of the guide rails 7. This is accomplished by constructing the guide rails so as to have portions at different levels as shown in FIG. 16. As shown there, guide rails 7 include a portion 46 in the region of the press which is at a lower level than the remaining portion 47 of the guide rail.

It is further possible to move the transfer car 15 into and out of the press in stationary guide rails 7 and to effect the contacting of the suction cups 18 with the finished laminate 4 by means of a rising press tup. To accomplish this, any suitable means such as shown schematically by reference characters 48, 49 may move the lower and/or upper press tups, respectively. Also, the entire transport car and associated elements may be raised and lowered by any suitable means 50, such as shown schematically in FIG. 17.

For certain laminating projects, it may be sufficient to replace the roller band 11 by a simple table or a simple plate 1*a*, which may possibly be liftable and lowerable with respect to the transfer car 15. The table will be made to rise and descend when the holding gibs are capable of advancing and retracting in the horizontal direction only. For raising and lowering the table, any suitable means such as shown at 50 in FIG. 17 may be employed.

What is claimed is:

1. A device for inserting a workpiece in the form of a laminating pack to be processed into a press in a charging direction and for extracting the workpiece which has become a processed laminate from the press in a discharging direction, the press having a plurality of sides, the device comprising:

means for charging the press by depositing a laminating pack therein, said charging means including a table for receiving, holding and discharging the laminating pack;

means for discharging the press by taking up a processed laminate from the press, said discharging means including a suction means for gripping the processed laminate by suction; said charging and discharging means being operatively coupled together for cooperation with each other;

a plurality of holding gibs which cooperate with said charging means for holding laminating packs deposited in the press by the charging means;

means for inserting a laminating pack into one side of the press and for extracting a processed laminate from the same side of the press and means for effecting simultaneous deposit of said laminating pack onto said holding gibs and take up of the processed laminate by said suction means;

said inserting and extracting means and said means for effecting simultaneous deposit and take up together comprising:

a transfer car which is movable into and out of the press, said transfer car having an upper part and a lower part, said table of said charging means being disposed on said upper part of said transfer car, said suction device of said discharging means being located on said lower part of said transfer car, so that said charging and discharging devices are located one above the other in said transfer car, said charging device, discharging device and transfer car all being part of a single unit which is movable into and out of the press.

2. A device according to claim 1:

wherein the laminating pack has a front side which is disposed opposite the one side of the press when the laminating pack has been inserted into the press;

including means for additionally supporting the laminating pack on the front side thereof when the laminating pack has been inserted into the press, said additional supporting means including a roller band which is movable into and out of the press, said additional supporting means cooperating with said charging means to effect depositing of the laminating pack in the press.

3. A device according to claim 1:

wherein the press is elongated and includes a longitudinal axis and two longitudinal sides which extend in parallel relationship to the longitudinal axis, the longitudinal sides also extending in perpendicular relationship to the one side of the press;

including means for effecting sliding movement of said holding gibs into and out of the press past the two longitudinal sides of the press and in a direction transverse to the longitudinal axis of the press, said sliding movement means being coupled with said holding gibs.

4. A device according to claim 3, wherein said sliding movement means for said holding gibs is mounted for raising and lowering movement with respect to the press.

5. A device according to claim 3:

wherein said holding gibs include a plurality of separate holding gib elements on one lateral side of the press and a plurality of separate holding gib elements on the other lateral side of the press.

6. A device according to claim 3 wherein the laminating pack has a width which extends transversely to the charging direction and wherein said transfer car and said table thereon each have a longitudinal axis which extends in the same direction as the longitudinal axis of the press, said transfer car and said table thereon each having a width which extends perpendicularly to said longitudinal axis thereof, said transfer car and said table thereon each being slightly narrower in width than the width of the laminating pack.

7. A device according to claim 6, wherein said transfer car and table thereon include means for effecting variation of said widths thereof.

8. A device according to claim 6:

wherein said transfer car includes lateral sides running parallel to its longitudinal axis;

including a pair of supporting cleats disposed externally of the press at the one side thereof, said supporting cleats cooperating with said holding gibs to serve as an extension thereof, said supporting cleats being fixed relative to said press so that said transfer car moves relative to said supporting cleats, said supporting cleats being disposed on opposite lateral sides of said transfer car and slightly laterally offset from said lateral sides thereof to thus serve as supports for the laminating packs when the transfer car is outside the press.

9. A device according to claim 1, wherein said holding gibs comprise hinged tongs capable of closing and opening.

10. A device according to claim 1, wherein said table includes a pair of displaceable roller bands thereon for effecting horizontal movement of laminating packs with respect to said transfer car, said roller bands being disposed in parallel relationship to each other.

11. A device according to claim 1:

wherein the laminating pack has a plurality of sheets therein and wherein said transfer car has a frontal side which faces toward the one side of the press when the transfer car is outside the press;

including means for clampingly engaging the laminating pack when the laminating pack is on the charging means of the transfer car to hold the sheets of the laminating pack together when the transfer car moves in the charging direction, said clamping means being coupled with said transfer car adjacent said frontal side of said transfer car.

12. A device according to claim 1:

wherein said transfer car has an exterior and has a frontal side which faces toward the one side of the press when said transfer car is outside the press;

including a projecting member on said transfer car for rollably supporting the workpiece in a region beyond the exterior of the transfer car, said projecting member projecting from said frontal side of said transfer car, said projecting member being mounted for generally upward and downward movement relative to said transfer car.

13. A device according to claim 1, wherein the press has a frontal side opposite the one side and wherein said holding gibs include a pair of spaced apart holding gib portions, each holding gib portion having a frontal side adjacent the frontal side of the press, said holding gib portions having means at their frontal sides for adjustably displacing said holding gib portions to effect accurate positioning of the laminating packs in the press.

14. A device according to claim 1, wherein said transfer car includes means for effecting lowering and raising thereof with respect to the press to, in turn, effect take up and discharge of the workpiece by said transfer car.

15. A device according to claim 1, including a plurality of guide rails with which said transfer car cooperates to effect guided movement of said transfer car, said guide rails having portions disposed at different levels to effect raising and lowering movements of said transfer car with respect to the press to, in turn, effect take up and discharge of the workpiece by the transfer car.

16. A device according to claim 1:

wherein the press includes upper and lower tups, the lower tup being raisable toward the upper tup;

including a plurality of guide rails which are fixed with respect to the press, said transfer car cooperating with said guide rails to effect guided movement of said transfer car;

wherein said guide rails extend to and from the press in the charging and discharging directions, so that the transfer car may run into and out of the press on said guide rails; and wherein said suction device is disposed on said transfer car as to grippingly contact the processed laminate when the lower tup is raised toward the upper tup of the press.

17. A device according to claim 1, wherein said table of said charging means is mounted on said transfer car for raising and lowering movement with respect thereto.

* * * * *